United States Patent [19]

Catricola

[11] Patent Number: 4,725,084

[45] Date of Patent: Feb. 16, 1988

[54] DOOR GUARD

[76] Inventor: Frank Catricola, 5701 Boulevard E., West New York, N.J. 07093

[21] Appl. No.: 835,093

[22] Filed: Feb. 28, 1986

[51] Int. Cl.[4] ..... E05C 19/06

[52] U.S. Cl. ..... 292/81; 292/346

[58] Field of Search ..... 292/81, 253, 346, 300, 292/303, DIG. 65

[56] References Cited

U.S. PATENT DOCUMENTS

| | | | |
|---|---|---|---|
| 1,399,897 | 12/1921 | Singer | 292/346 X |
| 1,853,456 | 4/1932 | Ross | 292/346 |
| 1,863,487 | 6/1932 | Kirkpatrick | 292/346 |
| 2,049,796 | 8/1936 | Barry | 292/346 |
| 2,144,075 | 1/1939 | Mora | 292/346 |
| 2,918,319 | 12/1959 | Richardson | 292/253 |
| 3,271,063 | 9/1966 | Garrett | 292/346 |
| 3,592,498 | 7/1971 | Raccuglia | 292/346 |
| 4,547,009 | 10/1985 | Allen | 292/346 |

*Primary Examiner*—Richard E. Moore

*Attorney, Agent, or Firm*—Arthur T. Fattibene

[57] ABSTRACT

A door guard to deter unauthorized entry that includes a pair of complimentary structural members having complimentary cross-sectional configurations to define interlocking portions that will engage to secure the free end of the door to the adjacent door frame. One of the complementary members is secured along the free end of the door and the other member is secured to the adjacent door jamb or frame. The arrangement is such that any effort to force the door as with a prying tool, will cause the interlocking portions to engage and thereby prohibit the door from being force opened. In another form of the invention, the complementary members are arranged and constructed to deter the forcing of the door latch.

2 Claims, 7 Drawing Figures

DOOR GUARD

FIELD OF INVENTION

This application is directed to a door guard or the like to deter unauthorized access.

PROBLEM AND PRIOR ART

Heretofore, various efforts have been made to secure an access opening such as a doorway, against unauthorized entry, e.g. those described in U.S. Pat. Nos. 3,271,063 and 3,592,498. In my prior application, Ser. No. 455,467 filed Jan. 3, 1983 entitled "Door Assembly and Anti-Jimmying Interlock For Use Therewith", now abandoned, and the art cited therein, other such efforts are disclosed. Accordingly, there are ongoing attempts to improve and/or develop security devices to protect against unauthorized entry.

A common technique used by a would-be burglar or trespasser to accomplish unauthorized entry is to pry or jimmy the existing door lock by inserting a tool such as a crowbar, screwdriver or the like between the free end of the door and the adjacent frame structure to force the door latch open, whereby unauthorized access is accomplished.

Another technique used by such unauthorized persons is to place a jack between the opposed vertical door frames and by extending the jack, force the door frames to bow outwardly an extent sufficient to separate the door lock latch from its catch on the door frame, permitting the door to be readily opened.

OBJECT

An object of this invention is to provide a novel door guard which is constructed to defeat the efforts of a would-be burglar from gaining unauthorized access.

Another object is to provide a door guard which is specifically constructed so as to render the door more secure in the event of any effort made to pry the door open.

Another object is to provide a door guard which is relatively simple in construction, which can be readily fabricated and which can be readily applied to existing doors with a minimum of effort and a maximum of ease.

SUMMARY OF THE INVENTION

The foregoing objects and other features and advantages are readily attained by a door guard comprising a pair of complementary structural members having a specific cross-sectional configuration to define complementary interlocking portions that will engage to secure the free end of the door to its adjacent door frame only when an effort is made to pry or jimmy the door by the commonly known techniques used by a would-be burglar. This is attained by securing one of the complementary members to the door adjacent its free end and by securing the other structural member to the door frame or jamb adjacent the free end of the door. The structural member secured to the door includes a forwardly extending flange portion having integrally connected thereto an interconnecting web portion adapted to be secured to the door by suitable fasteners, and a forwardly projecting portion terminating in a reversely formed hook. The other structural member is provided with a mounting portion which is fixedly secured to the door jamb and having connected thereto a laterally extending flexible portion which terminates in a reversely bent hook or catch. In the normal closed door position, the forwardly porjecting portion of the door member is received in the space between the mounting portion and the flexible portion of the frame structural member, with the complementary hook and catch of the respective members normally slightly spaced apart. The arrangement is such that in the event a prying tool is inserted between the complementary members to pry the door, the flexible portion of the frame structural member is deflected an amount to interlock the hook and catch of the respective members. Thus, the more one seeks to pry the door open, the more firm the interengagement of the complementary interlocking members becomes, and thereby prohibits the door from being forced open.

In another form of the invention, the door guard comprises a pair of complementary members comprising a vertical forwardly extending flange member secured to the door and which is adapted to be received in engagement with a receiving member secured to the door frame; the arrangement being such as to defeat the commonly known techniques for gaining unauthorized entry.

FEATURES

A feature of this invention resides in the provision of a door guard which includes complementary interlocking members which are normally in a disengaged position and which are interlockingly engaged to prevent unauthorized access when an effort is made to pry or jimmy the door.

Another feature is to provide a door guard formed of complementary members constructed to define complementary interlocking hooks that will interlock in the event the associated door is attempted to be pryed open.

Another feature is to provide a door guard comprised of a pair of complementary members, one of which comprises a projecting flange secured to the door adjacent the door lock and the other which comprises a receiver secured to the adjacent door frame.

Other features and advantages will become more readily apparent when considered in view of the drawings and description thereof in which.

DETAIL DESCRIPTION

Figure 2:
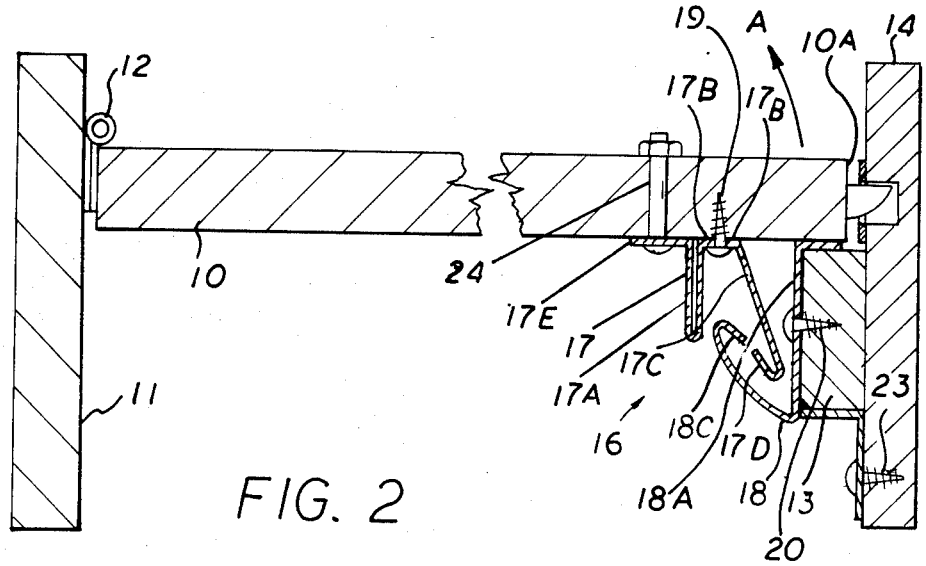
FIG. 2 is a sectional view taken on line 2—2 on FIG. 1, showing the parts in the normal closed door position.
Figure 3:
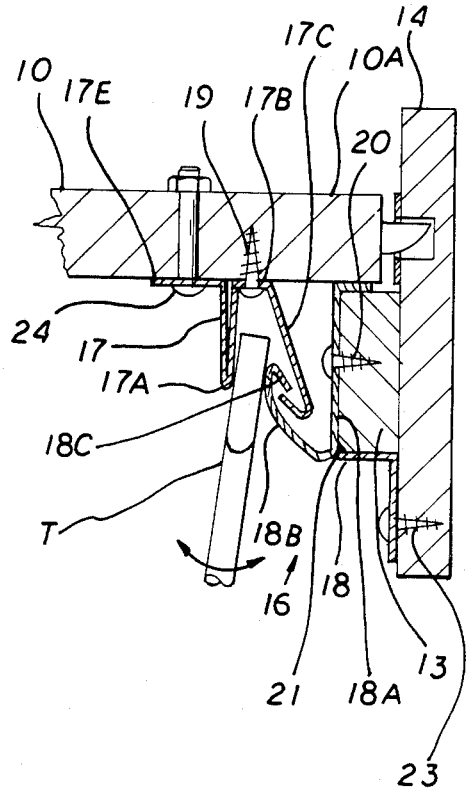
FIG. 3 is a fragmentary sectional view similar to that of FIG. 2 but illustrating the interlocking feature when an effort is made to pry or jimmy the door.
Figure 1:
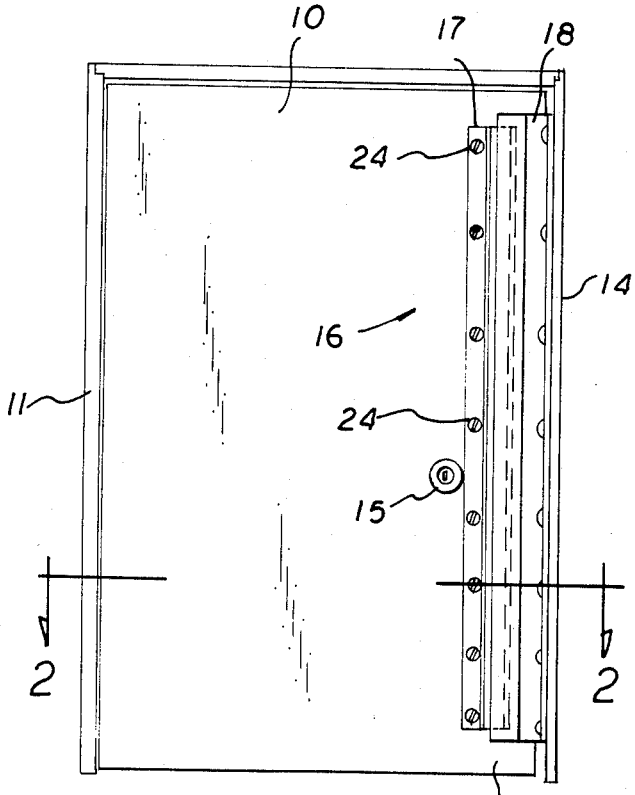
FIG. 1 is an elevation view of a door assembly utilizing a door guard of this invention.

Referring to the drawings, and in particular to FIGS. 1 to 3, there is illustrated a door guard embodying the invention.

As shown in FIG. 1, the door 10 is hingedly connected to a door frame 11 by suitable hinges 12 in a conventional manner. The free end 10A of the door 10 in the normally closed position abuts against a jamb 13 which is connected to the opposite verticle door frame 14. The door 10 is provided with a conventional door lock 15 which includes the usual lock latch and associated catch located in the door frame 14. In the illustrated embodiment, it will be apparent that the door opens in the direction of arrow A.

To prevent unauthorized forced entry, the door assembly is provided with a door guard 16 embodying the invention. The door guard 16 comprises a pair of complementary structure members 17 and 18. As shown, the respective complementary members 17 and 18 extend longitudinally of the door 10 adjacent its free end 10A and the adjacent door frame 14. The respective members 17 and 18 can be formed of suitable structural material, e.g. a metal casting, forged material and/or suitable high strength plastic material that is capable of withstanding the forces employed in forcing an unauthorized entry.

The structural member 17 as best shown in FIGS. 2 and 3 is provided with a cross-sectional shape that includes a forwardly extending vertical flange 17A that extends longitudinally of the door 10. Connected to flange 17A and extending laterally is a web portion 17B which defines a mounting portion by which the structural or door member 17 is secured to the door. Vertically spaced fasteners, e.g. screw or bolts 19, secured the member 17 to the door. Connected to the mounting portion or web 17B is a second flange 17C which projects forwardly of the door and preferably at a slight angle to the verticle. The free end of the second flange 17C is reversely bent to define a hook 17D.

The other structural member 18, which is secured to the adjacent door frame means 14 or jamb 13, comprises an elongated mounting portion or plate 18A which is secured to the door jamb 13 by suitable fasteners or screws 20. Connected to the mounting portion or plate 18A is a reversely extending flange or portion 18B, the free end of which terminates in a hook or catch 18C. It will be noted that the hook or catch 18C is spaced from the mounting portion 18A and slightly spaced from the hook 17D of the associated door structural member 17. The flange portion 18B, while formed of a rigid material, is nevertheless provided with a limited amount of flexibility so that when deflected, as will be hereinafter described, it will cause the associated hook or catch 18C to interengage or interlock with the hook 17D of the door structural member 17, when one attempts to force the door open.

In the illustrated embodiment, the structural member 18 includes an angle portion 18D which may be connected by a weld 21 to the mounting portion 18A. The angle portion 18D is fitted so that one flange or leg portion is disposed against the jamb and the other flange or leg portion secured to the door frame by fasteners 23.

If desired, the door structural member 17 may be provided with a laterally extending flange 17E disposed co-planner to the mounting portion or web 17B so as to expand the mounting area or portion of structural member 17. A carriage bolt or other fastener 24 may be provided to secure flange 17E to the door 10.

In the arrangement shown, it will be noted that in the normally closed door position, as best seen in FIG. 2, the projecting flange 17C and the associated hook portion 17D is normally received in the space defined by the moutning portion 18A of member 18 and is connected reverse flange 18B. Also, as shown in FIG. 2, the free end of hook 17D is slightly spaced from the hook or catch 18C. Thus, the door can be free to open or close without interference of the respective structural member 17, 18.

However, in the event one tries to pry or jimmy the door open by the insertion of a tool or crowbar T between the door and the frame to force the lock, the tool T can only be inserted in the space defined between flanges 17A and 18B of member 17 and 18 as seen in FIG. 3. If such attempt were made, the tool T would cause the flange 18B of member 18 to flex an amount sufficient for the hook or catch portion 18C to interlock or latch with hook 17D which would render it virtually impossible to open the door. Also, the projecting flange 17A functions as a fulcrum about which the tool pivots to cause the hooks 18C and 17D to interengage or overlap whether the tool "T" is displaced to left or right as seen in FIG. 3. The construction described also provides a double barrier between a prying tool T and the free edge 10A of the door and the associated door frame 14, the double barrier comprising the flange 17C of member 17 and the mounting portion 18A of member 18. It will also be apparent that the critical fasteners, e.g. screws 19 and 20, which hold the respective structural members 17 and 18 respectively to the door 10 and frame 14 are obscured in the assembled position, i.e., screws or fasteners 19 and 20 cannot be normally tampered with or removed. Fasteners 23 and 24 are primarily cosmetic, and their removal by a would-be burglar will not permit entry.

While the forward flange 17A of the member 17 is illustrated as a reversely bent piece, it will be understood that the flange 17A may comprise a single flat flange.

From the foregoing description, it will be apparent that the more force a would-be burglar uses in attempting to pry or jimmy the door, as seen in FIG. 3, the more secure the complimentary hooks 17D and 18C are interlocked or engaged.

Figure 5:
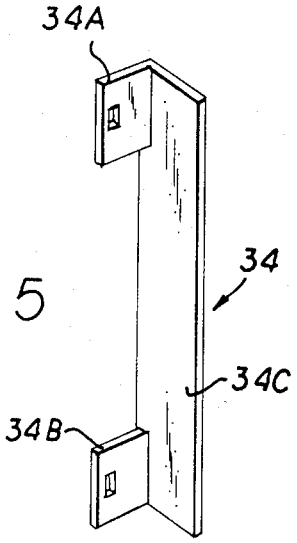
FIG. 5 is a perspective view of a detail of construction of one member of the modified embodiment.
Figure 4:
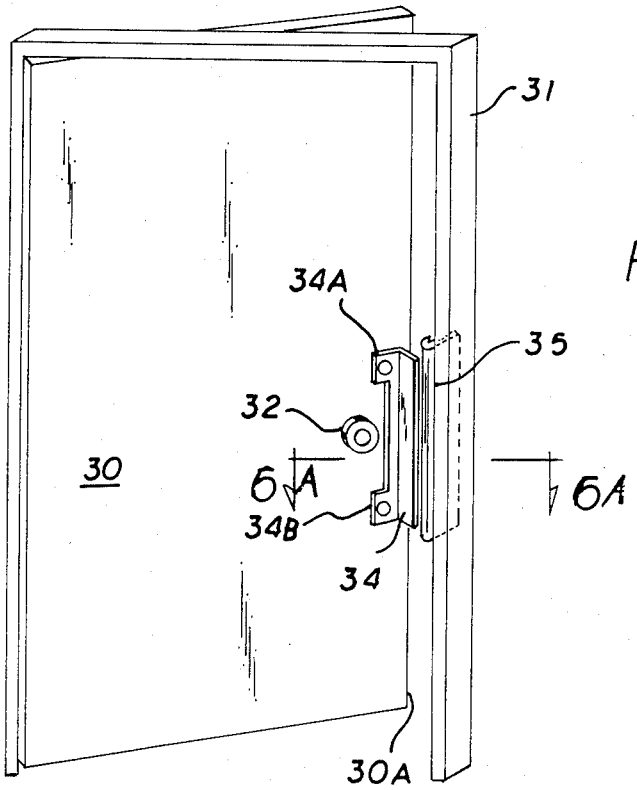
FIG. 4 is an elevation view of a modified embodiment.

FIGS. 4 and 5 illustrate a modified security device. In this form of the invention, a more simple security device is provided on the door 30 and associated frame 31; and which is located only in the vicinity of the door lock 32. In this form of the invention, the door structural member 34 comprises spaced apart mounting flanges 34A, 34B by which it is fixed to the door, e.g. carriage bolts or the like. Connected between the mounting flanges and projecting normal thereto is a forwardly projecting flange 34C. The entire member 34 is formed of a rugged material. As seen in FIG. 4, the member 34 is secured to the outer portion of the door 30 in the vicinity of the door lock 32, and adjacent to the free end 30A of the door.

A complementary structural member 35 is fixedly secured to the door frame 31 adjacent the lock. The member 35 comprises a mounting portion 35A by which it is secured to the door frame or jamb by suitable fasteners 36. The end of the member extending forwardly of the door is reversely bent to define a receiver or catch for the forward flange 34C of the door structural member 34. The upper and lower ends of structural member 35 are closed by bending the upper end portions $35A^1$ of the mounting portion 35A so as to overlie the reversely bent end 35B. As shown, the closed ends are provided with a curved or inclined edge 36 so as to deter any effort of prying as the curved or inclined edge is incapable of providing a firm support for a prying tool.

Figure 6:
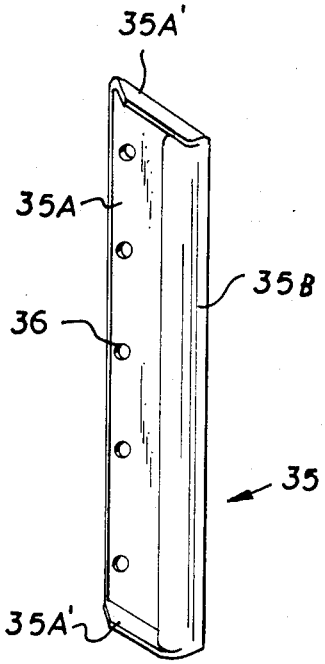
FIG. 6 is a perspective view of a detail of construction of the other member of the modified embodiment.
Figure 6A:
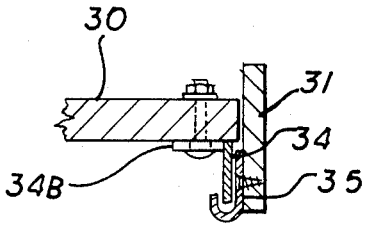
FIG. 6A is a sectional view taken along line 6A—6A on FIG. 4.

In this form of the invention, the respective members 34 and 35 are interengaged in the closed position of the door as seen in FIG. 6A. The arrangement is such that the members 34 and 35 present a rigid barrier to any type of prying tool which may be used to jimmy or pry the lock so as to separate the lock latch from its catch located in the door frame 31.

From the foregoing description, it will be apparent that the described complementary structural members can be formed of structural metals or material by casting, rolling or bending, welding or by any of the well known metal working methods. They may be formed as an integral or unitary structure, or may be formed of multiple parts which can be integrally connected as by welding and the like.

While the invention has been described with respect to the described embodiments, it will be understood and appreciated that variations and modifications can be made without departing from the spirit or scope of the invention.

What is claimed is:

1. A door guard for use on a door to deter unauthorized entry comprising a pair of complementary structural members, means adapted for securing one of said members adjacent to the free end of a door, and for securing the other member to a door frame means adjacent the free end of the door, each of said members extending longitudinally of the door and adjacent frame means, said members in cross section defining complementary interengaging hooks, said hooks being normally disengaged in a normally door closed position whereby the door can swing freely between open and closed position, and which hooks are positioned to engage to interlock in the event the door is pryed to prohibit the door to open, wherein one of said structural members comprises a forwardly extending flange extending longitudinally of said door, a mounting portion extending laterally of said flange, a second flange extending in a generally forwardly extending position, said mounting portion being connected to and between said forwardly extending flange and said second flange, said second flange having a free end, said free end being reversely bent to define a hook, and the other of said structural member comprising a mounting plate adapted to be connected to the frame means, and a reverse flange connected to said mounting plate, said reverse flange being adapted to extend between the forwardly extending flange and said seconf flange of said one structural member, said reverse flange terminating in a reversely bent catch complementing the hook of said seconf flange, said respective hook and catch being slightly spaced from one another in the closed door position, whereby said hook and catch are adapted to interlock when an effort is made to pry the door open.

2. A door guard as defined in claim 1 wherein said mounting plate of said other structural member includes an angle portion.

* * * * *